US007070513B2

(12) United States Patent
Takeda et al.

(10) Patent No.: US 7,070,513 B2
(45) Date of Patent: Jul. 4, 2006

(54) GOLF CLUB

(75) Inventors: Hitoshi Takeda, Niigata-ken (JP); Masami Niimura, Tokyo (JP); Iwao Fukino, Tokyo (JP)

(73) Assignee: K.K. Endo Siesakusho (JP)

( * ) Notice: Subject to any disclaimer, the term of this patent is extended or adjusted under 35 U.S.C. 154(b) by 0 days.

(21) Appl. No.: 10/979,335

(22) Filed: Nov. 2, 2004

(65) Prior Publication Data

US 2005/0107183 A1 May 19, 2005

(30) Foreign Application Priority Data

Nov. 13, 2003 (JP) ..... 2003-384318

(51) Int. Cl.
*A63B 53/04* (2006.01)

(52) U.S. Cl. ..... 473/329; 473/332; 473/342; 473/345

(58) Field of Classification Search ..... 473/332, 473/342, 324, 345–346, 329
See application file for complete search history.

(56) References Cited

U.S. PATENT DOCUMENTS 4,792,139 A * 12/1988 Nagasaki et al. ..... 473/342
5,290,036 A * 3/1994 Fenton et al. ..... 473/332
5,299,807 A * 4/1994 Hutin ..... 473/329
5,316,298 A * 5/1994 Hutin et al. ..... 473/332
5,398,929 A * 3/1995 Kitaichi ..... 473/329
5,403,007 A * 4/1995 Chen ..... 473/342
5,524,331 A * 6/1996 Pond ..... 29/527.4
5,766,092 A * 6/1998 Mimeur et al. ..... 473/329
5,772,527 A * 6/1998 Liu ..... 473/324
6,443,857 B1 * 9/2002 Chuang ..... 473/332
6,872,153 B1 * 3/2005 Gilbert et al. ..... 473/332
2002/0165040 A1 * 11/2002 Kosmatka et al. ..... 473/332

FOREIGN PATENT DOCUMENTS

JP 06-039061 2/1994
JP 09-322952 12/1997

* cited by examiner

*Primary Examiner*—Sebastiano Passaniti
(74) *Attorney, Agent, or Firm*—Akerman Senterfitt

(57) ABSTRACT

A recess portion is formed on a front side of a head body, and a gel is placed in the recess portion. A face member is fixed on the head body so as to seal the gel in the recess portion. Thus, the gel can be certainly provided on the rearward of the face, whereby a hitting force (striking force) can be improved, while a sound generated when hitting a golf ball can be reduced. The sealed gel sticks to the recess portion without forming any space in a condition that it is pressed therein. Thus, the sound generated when hitting a golf ball can be made uniform, ensuring the transmission of a force for hitting a golf ball.

8 Claims, 7 Drawing Sheets

GOLF CLUB

BACKGROUND OF THE INVENTION

1. Field of the Invention

The present invention relates to a golf club.

2. Description of the Related Art

Recently, a face and a body of a golf club head are made thin in order for example, to increase a size of the head so as to enlarge a sweet spot and enhance a repulsive force of the head so as to improve a carry. Accordingly, a material having high-strength and high-hardness has come into use for this thinning purpose. In a golf club having a head made of a high-strength and high-hardness material, since a sound generated by hitting a golf ball is too high, the sound is not only harsh, but there have been concerns about a harmful effect on ears of a player, etc.

As a technique for solving those problems, for instance, Japanese Unexamined Patent Publication No. 6-39061 discloses a head which comprises a metallic face and a head body, both defining a hollow interior of the head, wherein the hollow interior is filled with a filler material such as non-metallic plastic, a thermoplastic material, an elastomeric material or a material with metallic particles or metal spheres added as a filler thereto.

Moreover, as a technique of providing a non-metallic material for a head, Japanese Unexamined Patent Publication No. 9-322952 discloses an iron head having a recess portion on its rear side, wherein an organic material having a preset Young's modulus of from 1 to 10000 MPa is provided on the recess portion; an intimate contact area between an inner surface of the recess portion and the organic material is arranged to be more than or equal to 10 $cm^2$; the organic material is, for instance, a vulcanized gum such as butadiene rubber, natural rubber, SBR, thermosetting resin such as urethane resin and epoxy resin, and thermoplastic resin such as polyethylene, polystyrene, polyamide, and polyvinyl chloride.

The above described conventional techniques are aimed at obtaining a comfortable sound when hitting a golf ball by using an organic material such as plastic, thermoplastic material, elastomeric material, vulcanized gum or the like. Those materials, however, are too soft when having rich elasticity, while they have only poor elasticity when having rich hardness. Accordingly, there is a problem that combining elasticity and hardness is difficult.

SUMMARY OF THE INVENTION

The present invention has been made to solve the above problem. It is, accordingly, an object of the present invention to provide a golf club which has a head having good elasticity and hardness, while the head can generate a comfortable sound when hitting a golf ball.

In order to attain the above object, according to a first aspect of the present invention, there is provided a golf club comprising a head and a shaft, the head having a face, while the shaft being connected to one side of the head, wherein: a gel is sealed in a rearward of the face so as to be opposite thereto; and the gel has a Young's modulus of 30 to 1500 kPa, with hardness of 50 to 200 penetration ratio (1/10 mm) or 25 to 65 ASKER C.

According to the first aspect of the present invention, since the gel combines elasticity and hardness, a hitting force when hitting a golf ball can be improved, while a sound generated by hitting the golf ball can be reduced.

In order to attain the above object, according to a second aspect of the present invention, there is provided a golf club comprising a head and a shaft, the head having a face, while the shaft being connected to one side of the head, wherein: the head comprises a face member having the face and a head body allowing the shaft to be connected thereto; a recess portion is formed on a front side of the head body for placing a gel therein; and the face member is fixed on the head body so as to seal the gel in the recess portion.

According to the second aspect of the present invention, the gel can be certainly provided on the rearward of the face by sealing it in the recess portion formed on the front side of the head body, and thus the improvement of the striking force and the reduction of the sound generated by hitting the golf ball can be obtained.

Alternatively, in the above golf club of the first and second aspects, the gel may be sealed in the head with the gel being pressed in the recess portion.

Moreover, a thickness of the gel under an atmospheric pressure may be greater than 1.0 mm.

Further, the Young's modulus of the gel divided by the thickness thereof may be less than 30 to 1500 kPa/mm.

BRIEF DESCRIPTION OF THE DRAWINGS

These objects, other objects and advantages of the present invention will become more apparent upon reading of the following detailed description and the accompanying drawings in which.

DETAILED DESCRIPTION OF THE PREFERRED EMBODIMENTS

Preferred embodiments of the present invention will now be described in detail with reference to the accompanying drawings.

Figure 1:
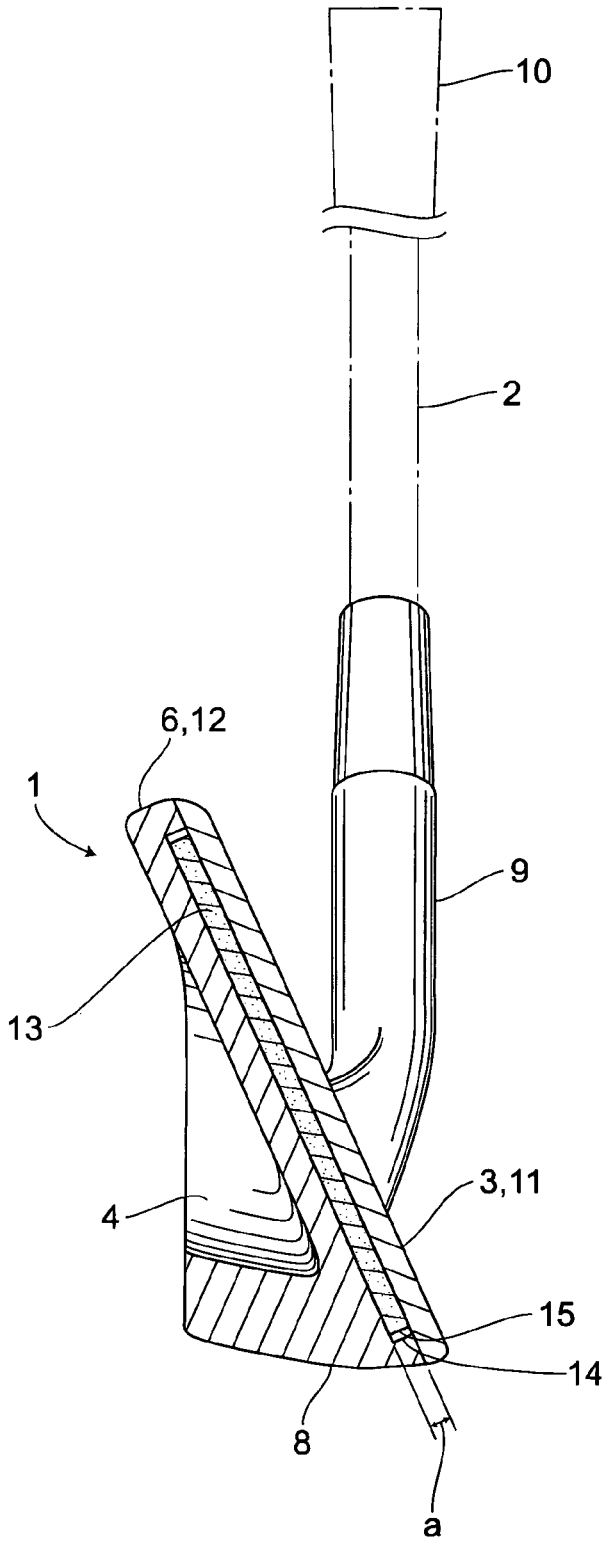
FIG. 1 is a cross sectional view showing a structure of a golf club according to a first embodiment of the present invention.
Figure 2:
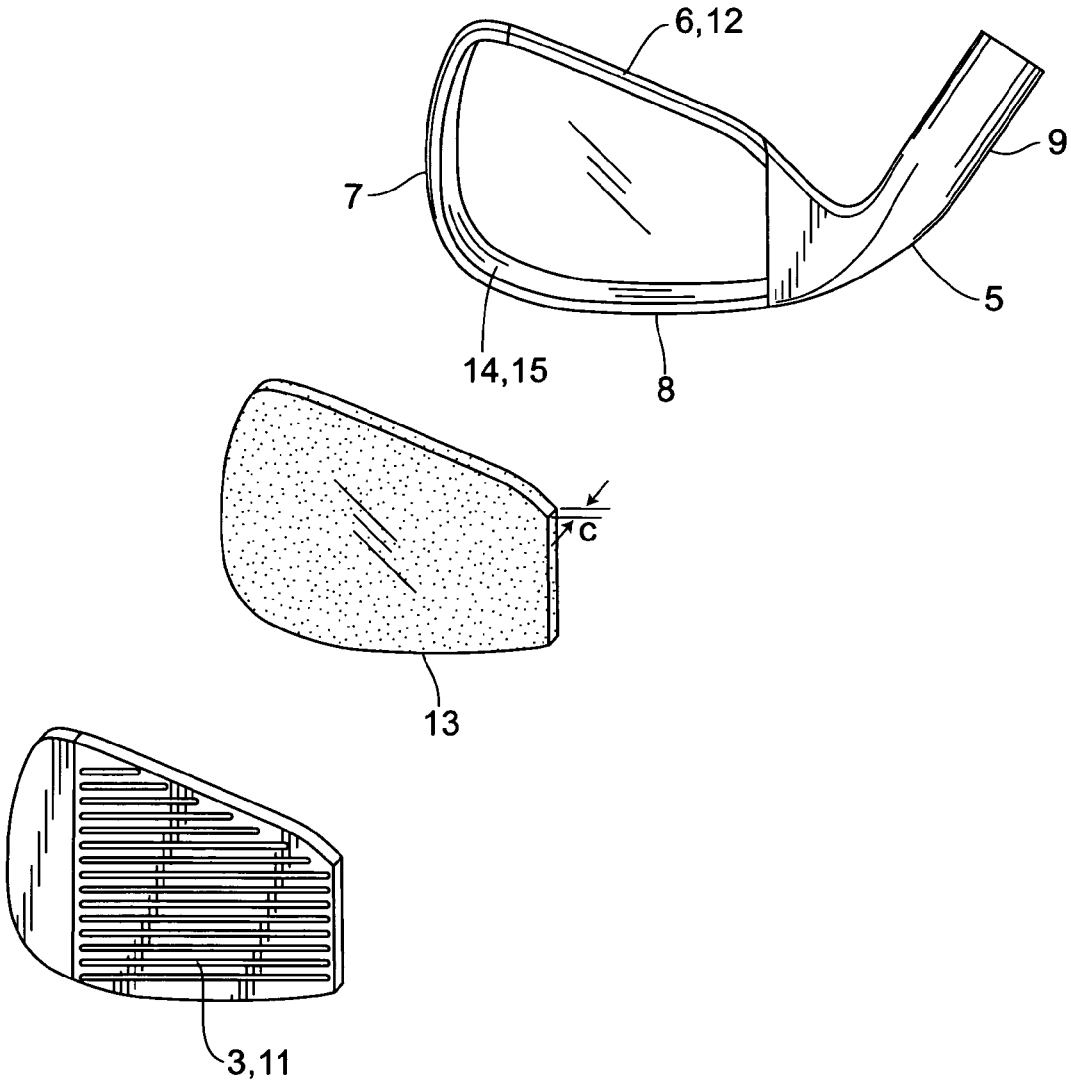
FIG. 2 is an exploded view showing the golf club of FIG. 1.
Figure 3:
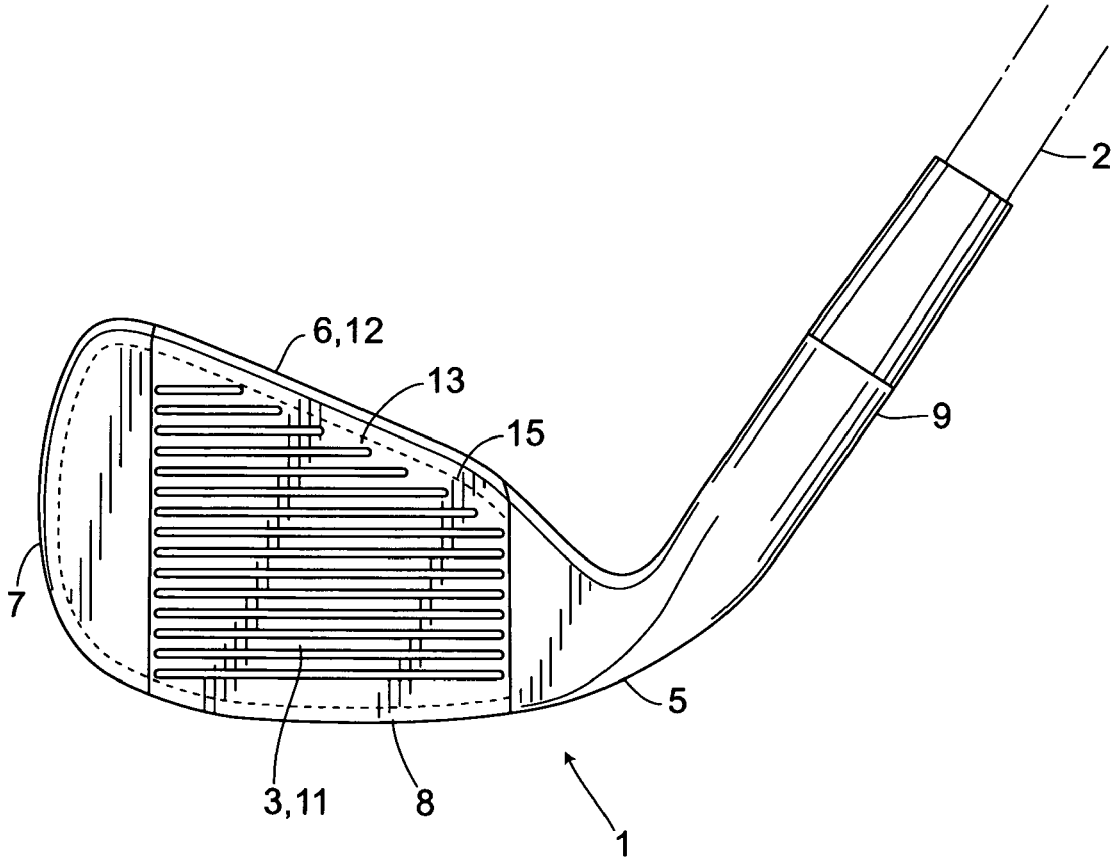
FIG. 3 is a front view showing the golf club of FIG. 1.

FIGS. 1 to 3 show a first embodiment. An iron golf club comprises a head 1 and a shaft 2 connected to one side of the head 1. The head 1 is formed with a face 3 on a front side thereof, a recess portion 4 for forming a cavity back on a rear side thereof, a heel 5 on one side, a top 6 on an upper portion thereof, a toe 7 on the other side, a sole 8 on a lower portion thereof, respectively. A shaft connecting portion 9 is formed on an upper portion of the heel 5. A lower end of the shaft 2 is connected to the shaft connecting portion 9, while the upper portion thereof is provided with a grip 10.

The head 1 comprises: a thin-walled face member 11 and a head body 12 the head body 12 being provided with other portions than the face 3, such as the recess portion 4, the heel 5, the top 6, the toe 7, the sole 8 and the shaft connecting portion 9. The face member 11 is made of a material comprised, for instance, of: 0.50–0.58% of C; 0.15–0.35% of Si; 0.75–1.0% of Mn; at most 0.02% of P; at most 0.02% of S; 0.4–0.7% of Ni; 0.4–0.6% of Cr; 0.15–0.25% of Mo; and 0.1–0.25% of V. A thickness of the material is less than 2.5 mm but greater than 0.9 mm (2.5 mm>thickness>0.9 mm). It is preferable that the thickness thereof be less than 2.0 mm but greater than 1.0 mm (2.0 mm>thickness>1.0 mm). This material is punched out into a predetermined shape from a tabular material, quenched and tempered so that degree of hardness thereof would be greater than or equal to HRC 45, preferably greater than or equal to HRC 50. The head body 12 is formed by forging S20C.

A gel 13 having a cushioning property is provided in between the face member 11 and the head body 12. The gel 13 is one obtained by allowing a colloid solution to lose its fluidity and to become solidified in a jelly form with elasticity and hardness, and the gel 13 is a two-phase colloid solution composed of a solid and a liquid. A recess portion 14 for placing the gel 13 therein is formed on a front side of the head body 12 so as to be opposite to the face 3. The recess portion 14 is formed into a shallow form having a depth "a" of about 1–5 mm, while an edge 15 thereof is formed so as to extend along the insides of the top 6, toe 7 and sole 8. The sheet-like gel 13 is placed in the recess portion 14. When placing the gel 13 in the recess portion 14, the gel 13 is pressed into the recess portion 14. To be more precise, the gel 13 whose volume is slightly larger than that of the recess portion 14 under the atmospheric pressure is prepared and then the gel 13 thus prepared is pressingly placed into the recess portion 14. For instance, the sheet-like gel 13 is formed so as to have a front side essentially of the same shape as that of the recess portion 14, to have a thickness "c" which is a little bit larger than the depth "a" of the recess portion 14 (c>a) under the atmospheric pressure. For instance, in a case that the thickness of the gel 13 when placed in the recess portion 14 is 1.8 mm, the gel 13 is formed to have the thickness "c" of 2 mm under the atmospheric pressure. After placing the gel 13 in the recess portion 14, the face member 11 is brought to the front side of the recess portion 14 and fixed thereto by welding or the like so as to seal the gel 13 in the recess portion 14 with the gel 13 being pressed therein.

For examples, the properties of the gel 13 may be as follows: a specific gravity of 0.5–1.2, preferably 0.9–1.1, and more preferably 1.05–1.06, under the atmospheric pressure; a hardness indicated by a penetration ratio (1/10 mm) of 50–200 or ASKER C of 25–65, preferably penetration ratio of 50–105 (1/10 mm) or ASKER C of 30–55; a tensile strength of 0.02–2.5 MPa, preferably 0.2–2.0 MPa, and more preferably 0.23–1.23 MPa; an elongation percentage (JIS K6251) of 200–800%, preferably 400–750%; a Young's modulus of 30–1500 kPa, preferably 30–150 kPa; and a compression set of 10% or below, preferably 5% or below. Meanwhile, the penetration ratio (1/10 mm) is a ratio or hardness index expressing a depth to which a needle of a predetermined weight can penetrate a gel in a predetermined time (JIS K2207). The ASKER C is also a hardness index scaled by a rubber hardness meter, expressing a distance by which a needle protruding with a spring pressure is pushed back when contacting a surface of a gel (SRIS). As the gel meeting those properties, "α GEL" (registered trademark) made by GELTECH Co., Ltd. is known, of which the type "„-5" or "„-7" is preferable.

Alternatively, the gel 13 may be a silicon-based gel having a penetration ratio of about 50–200 (the penetration ratio under the JIS K2530-1976-50 g load) in which 25–50 percent by weight of a plurality of hollow and fine spheres of 5 „m–300 „m diameter, made of an organic material such as an acrylic material, may be mixed, thus improving properties of the silicon gel such as the vibrational wave absorbing property.

Next is a description of how the above-structured golf club works. When the golf club is swung to hit a golf ball on the face 3, a hitting force is applied to the golf ball via the face 3. A reaction force of this hitting is transmitted to the head 1. To be more precise, the reaction force is transmitted from the face member 11 to the head body 12 entirely via the gel 13, whereby the reaction force is absorbed and buffered through the gel 13, while a sound generated when hitting the golf ball is reduced. Moreover, since the gel 13 has good elasticity, elasticity of the face member 11 can be enhanced, in addition, since the gel 13 is filled with the same being pressed, hardness thereof is assured, and thus hardness of the face 3 is also assured.

Figure 4:
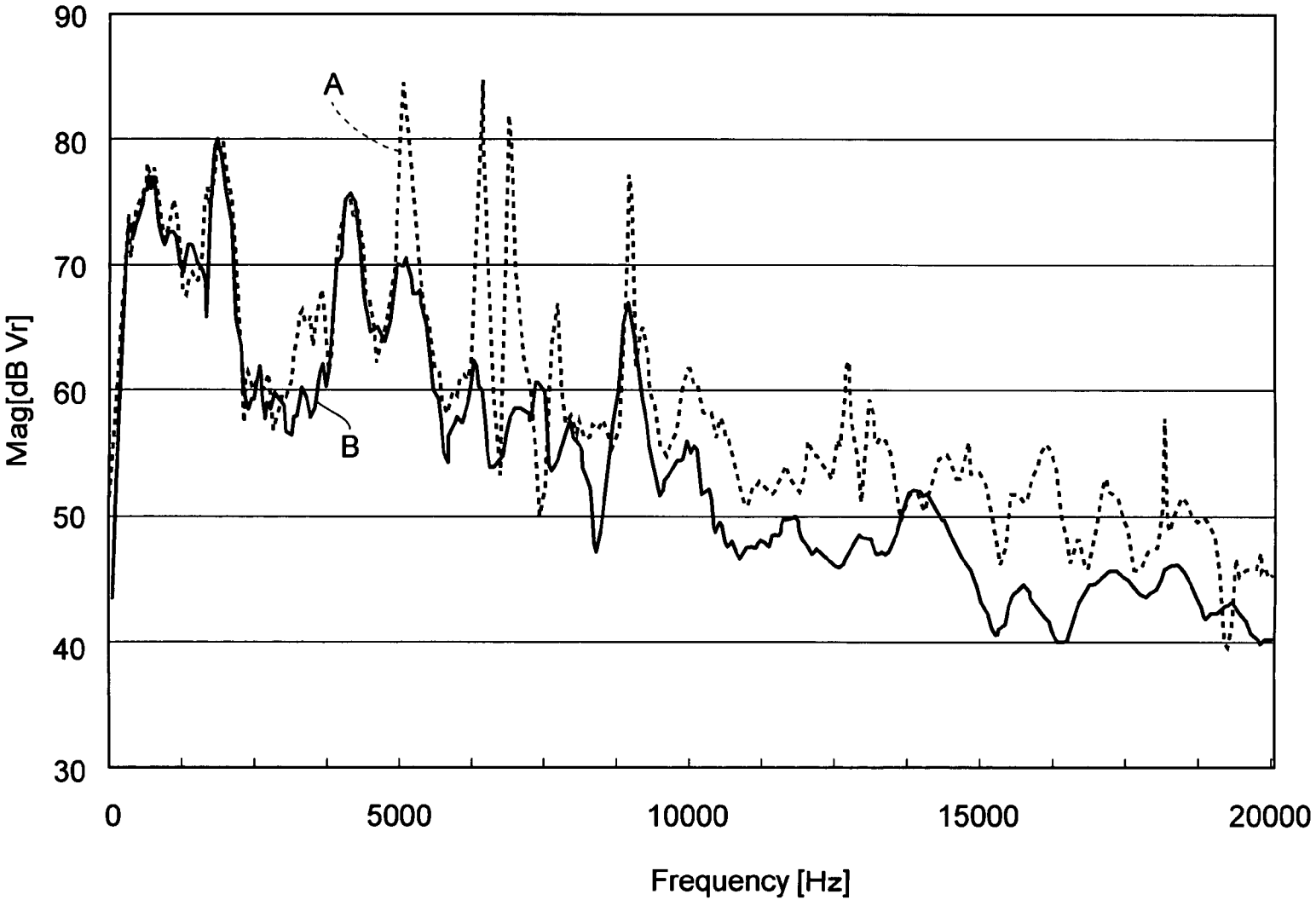
FIG. 4 is a graph for explaining a comparative experiment in the first embodiment.

A hitting sound experiment will now be explained with reference to FIG. 4. In FIG. 4, "A" denotes a sound intensity (in dB) in respective frequencies when a golf ball is hit by the face 3 with the recess portion 14 being hollow. "B" denotes a sound intensity (in dB) in respective frequencies when a golf ball is hit by the face 3 with the gel 13 („-7, 2 mm thickness) being sealed in the recess portion 14. The graph B shows reduced sound intensities compared to those denoted by the graph A. Specifically, in the range of the frequencies between 5000 and 10000 Hz, the difference between them was noticeably large. Moreover, in an actual ball hitting experiment, one having the sealed gel 13 of at least 1.0 mm thickness under the atmospheric pressure achieved a comparatively desirable result as compared to the others, such as one having the sealed gel 13 of 0.8–0.9 mm thickness. Specifically, it is preferable that a Young's modulus of the gel 13 over the thickness thereof (Young's modulus kPa/thickness mm) be less than 30–1500 kPa/mm.

As explained above, according to the first embodiment, the gel 13 is provided on the rearward of the face 3 so as to be opposite to the face 3. Since the gel 13 combines elasticity and hardness, a force to be applied to a golf ball when hitting the same can be improved, while a sound generated when hitting the golf ball can be reduced.

Moreover, the gel 13 can be reliably provided on the rearward of the face 3 by forming the recess portion 14 on the front side of the head body 12, placing the gel 13 in the recess portion 14, fixing the face member 11 on the head body 12 so as to seal the gel 13 in the recess portion 14, whereby the improvement of a hitting force (striking force) and the reduction of a sound generated when hitting a golf ball can be carried out. In addition, the sealed gel 13 closely contacts the recess portion 14 without any clearance with the same being pressed therein, and thus a sound generated when hitting a golf ball can be made uniform, while ensuring the transmission of the force to a golf ball.

Further, by allowing the gel 13 to have a thickness of greater than or equal to 1.0 mm under the atmospheric pressure, and to have the Young's modulus divided by the thickness thereof (Young's modulus kPa/thickness mm) less than 30–1500 kPa/mm, suitable elasticity and hardness can be assured.

Specifically, in a case that the gel 13 is a silicon-based-gel mixed with the plurality of tiny-hollow spheres, the vibrational wave from the outside thereof can be rapidly dispersed within the base material, and at the same time absorbed by intermolecular frictional resistance associated with the deformation of the base material and the frictional resistance generated between the silicon gel and the tiny-hollow spheres in association with that deformation. Since the tiny-hollow spheres are mixed in the silicon gel, a spring constant of a vibration-proof material is to be enlarged by the tiny-hollow spheres, absorbency of vibration wave, resonant frequency, magnification of resonance, hardness or the like can be adjusted by the amount of the tiny-hollow spheres mixed.

Figure 5A:
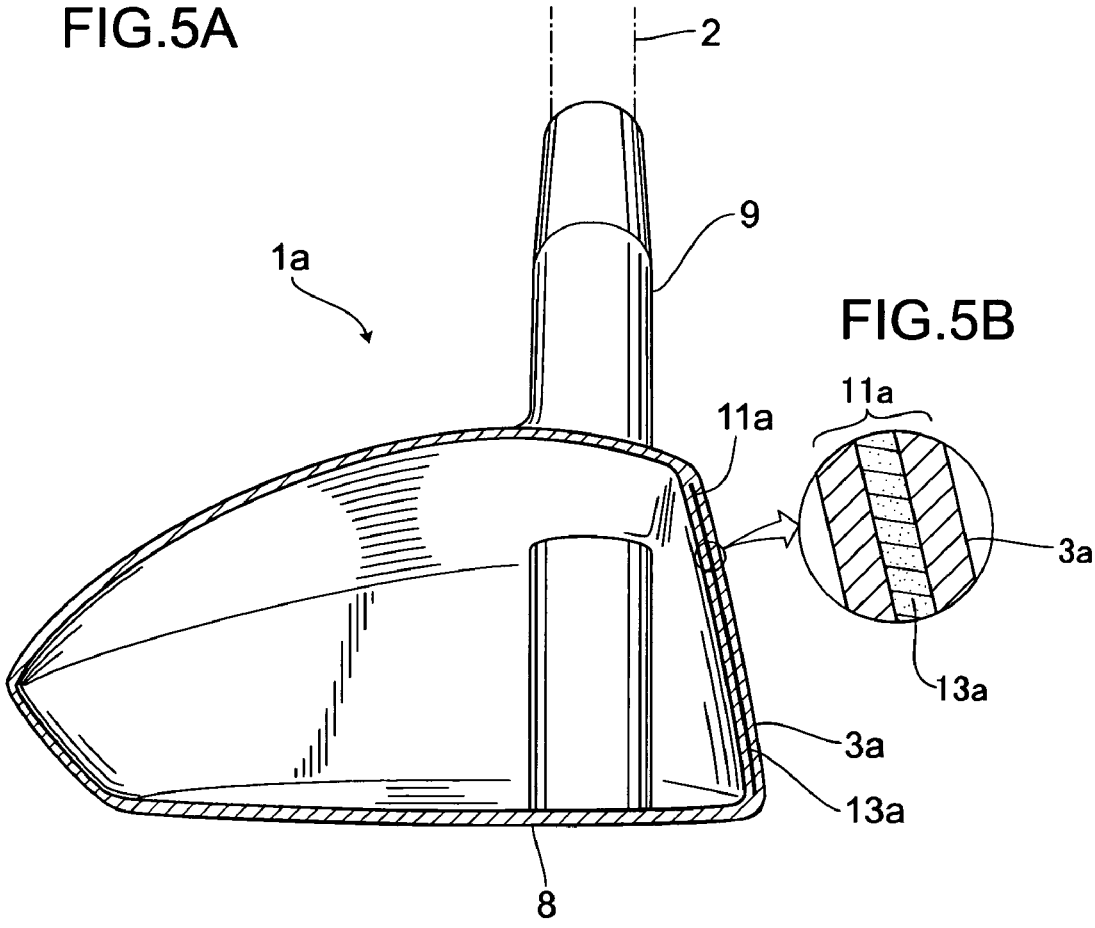
FIGS. 5A and B are partly enlarged cross sectional view showing a golf club according to a second embodiment of the present invention.

Next, a second embodiment of the present invention will now be explained with reference to FIG. 5. The same reference numbers will denote the same structure portions as those of the first embodiment, while detailed explanations thereof will be omitted. In the figure, a head 1*a*, so called "metal wood" employs a hollow structure comprising a plurality of metallic shells, wherein a gel 13*a* is sealed in an intermediate portion of a face shell 11 on a front side of the head 1*a* a along its thickness direction so as to be opposite to a face 3*a*. The gel 13*a* is one prior to being solidified, and thus not losing fluidity, which is sealed in with the same being pressed, but it may be filled in the same manner as the first embodiment.

The metal wood employing the above structure can improve a sound generated when hitting a golf ball, as well as elasticity and hardness of the head 1*a*.

Figure 6:
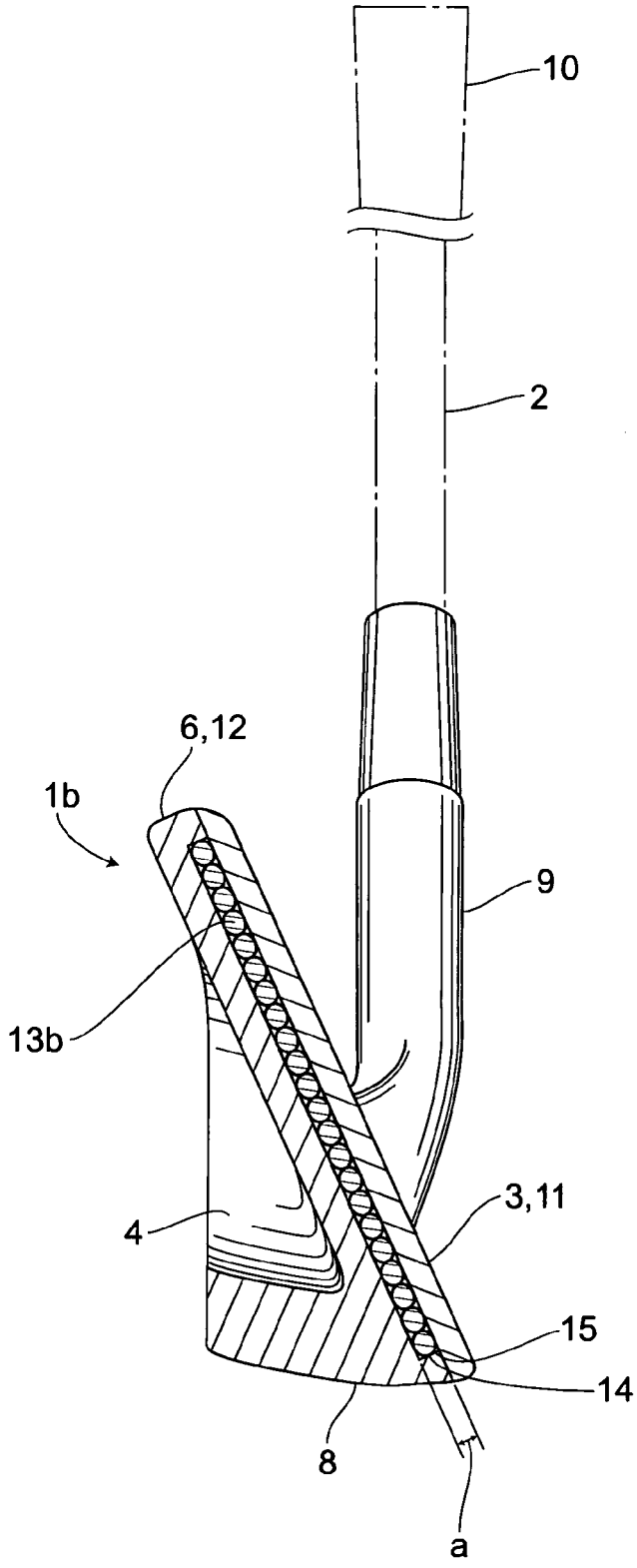
FIG. 6 is a cross sectional view showing a golf club according to a third embodiment of the present invention.

A third embodiment of the present invention will now be explained with reference to FIG. 6. The same structure portions as those of the first embodiment will be denoted by the same reference numbers, while detailed explanations thereof will be omitted. In the third embodiment, a gel 13*b* comprises a plurality of spherical grains. A diameter of each spherical grain under the atmospheric pressure is slightly larger than the depth "a" of the recess portion 14. The plurality of spherical grains of the gel 13*b* are pressed and filled in flat by providing the gel 13*b* in the recess portion 14 and plugging the recess portion 14 with the face member 11.

By providing the gel 13*b* comprising the plurality of spherical grains to the rearward of the face 3 so as to be opposite to the face 3, a sound generated when hitting a golf ball, elasticity and hardness of a head 1*b* can be improved.

Figure 7:
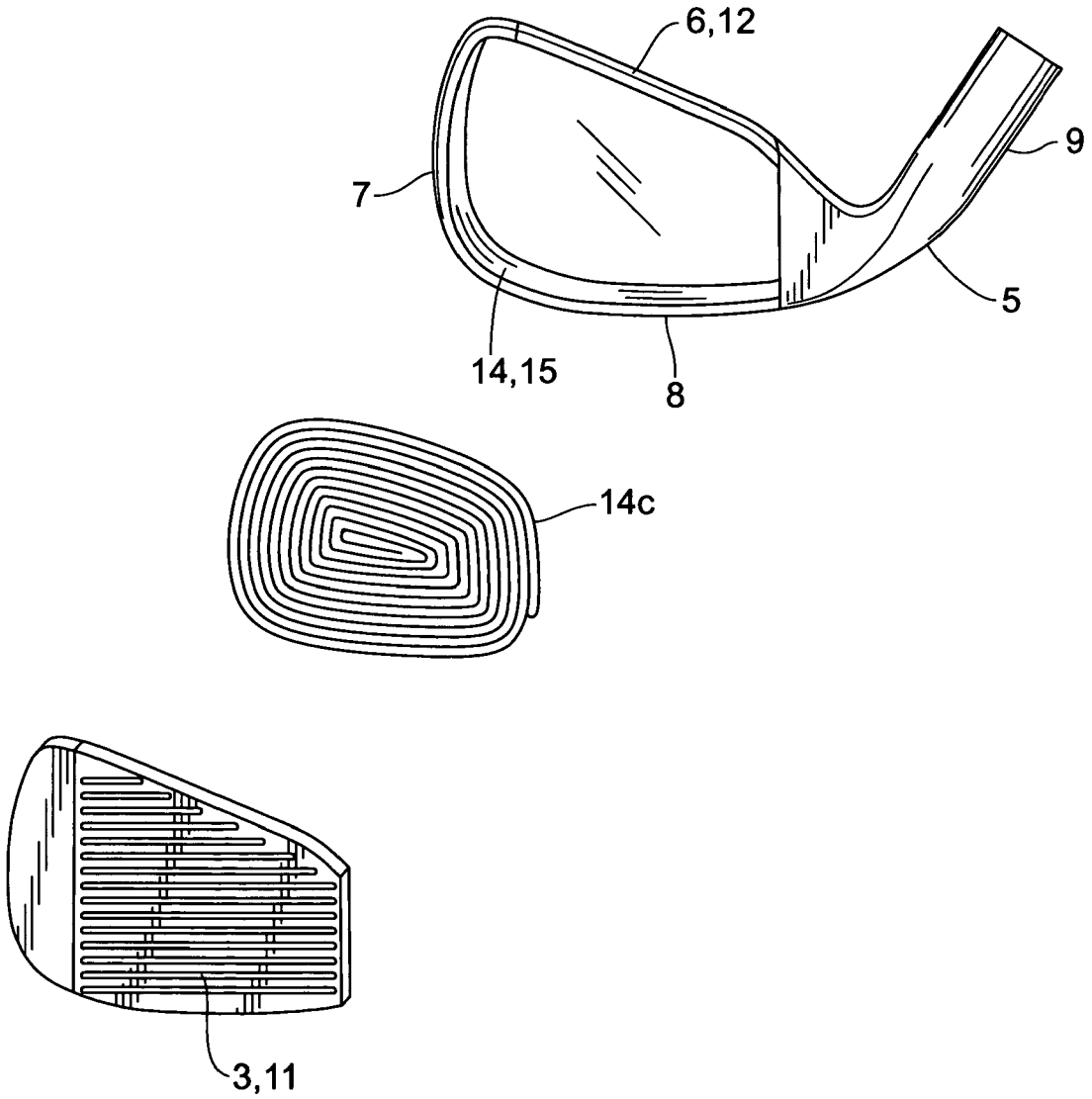
FIG. 7 is an exploded view showing a golf club according to a fourth embodiment of the present invention.

Next, a fourth embodiment of the present invention will now be explained with reference to FIG. 7. The same structure portions as those of the first embodiment will be denoted by the same reference numbers, while detailed explanations thereof will be omitted. In the fourth embodiment, a gel 13*c* is formed in an elongated string shape, while a cross section thereof under the atmospheric pressure is circular. A diameter thereof is larger than the depth "a" of the recess portion 14. The gel 13*c* is formed in scroll and provided in the recess portion 14. A center of the scroll is essentially arranged on a center of the face 3, while an edge of the gel 13*c* is arranged along an edge 15. The gel 13*c* in an elongated string shape is pressed and sealed in the recess portion 14 by plugging the recess portion 14 with the face member 11 so that the circular cross section of the gel 13*c* is to be flat.

By providing the gel 13*c* of an elongated string shape rearwardly of the face 3 so as to be opposite to the face 3, a sound generated when hitting a golf ball, elasticity and hardness of a head can be improved.

The present invention is not limited to the above embodiments, various embodiments and changes may be made thereonto without departing from the broad spirit and scope of the present invention. The structure portions of a golf club according to the present invention are not limited to ones in the above embodiment. For instance, the present invention may be applied to a putter.

What is claimed is:

1. A golf club comprising a head and a shaft, said head having a face, while said shaft being connected to one side of said head, wherein:

said head comprises a face member having said face and a head body with said shaft to be connected thereto;

a recess portion is formed on a front side of said head body for placing a gel therein; and said face member is fixed on said head body so as to seal said gel in said recess portion, wherein said gel is formed as a sheet, formed so as to have a front side essentially of the same shape as that of said recess portion, and to have a thickness slightly larger than a depth of said recess portion under atmospheric pressure, whereby said face member is brought to the front side of said recess portion and fixed to the head body so as to seal said gel in said recess portion with the gel being pressed therein.

2. The golf club according to claim 1, wherein said face has a degree of hardness greater than or equal to HRC 45, and wherein said gel is a silicon-based gel having a penetration ratio of about 50–200 according to JIS K2530-1976 under a 50 g load, and in which 25–50 percent by weight of a plurality of hollow and fine spheres made of an organic material is mixed.

3. The golf club according to claim 1, wherein a thickness of said gel under an atmospheric pressure is greater than 1.0 mm.

4. The golf club according to claim 2, wherein a thickness of said gel under an atmospheric pressure is greater than 1.0 mm.

5. The golf club according to claim 1, wherein a Young's modulus of said gel over a thickness thereof is less than 30 to 1500 kPa/mm.

6. The golf club according to claim 2, wherein a Young's modulus of said gel over a thickness thereof is less than 30 to 1500 kPa/mm.

7. The golf club according to claim 3, wherein a Young's modulus of said gel over the thickness thereof is less than 30 to 1500 kPa/mm.

8. The golf club according to claim 4, wherein a Young's modulus of said gel over the thickness thereof is less than 30 to 1500 kPa/mm.

* * * * *